US006326546B1

(12) United States Patent
Karlsson

(10) Patent No.: US 6,326,546 B1
(45) Date of Patent: Dec. 4, 2001

(54) STRAIN RELIEF FOR A SCREEN CABLE

(76) Inventor: Per Karlsson, Grindtorpsvägen 21, Täby (SE), 183 32

( * ) Notice: Subject to any disclaimer, the term of this patent is extended or adjusted under 35 U.S.C. 154(b) by 0 days.

(21) Appl. No.: 09/269,206

(22) PCT Filed: Sep. 25, 1997

(86) PCT No.: PCT/SE97/01617

§ 371 Date: Mar. 31, 1999

§ 102(e) Date: Mar. 31, 1999

(87) PCT Pub. No.: WO98/15044

PCT Pub. Date: Apr. 9, 1998

(30) Foreign Application Priority Data

Oct. 3, 1996 (SE) ..... 9603614

(51) Int. Cl.[7] ..... H01R 13/648; H01R 13/58

(52) U.S. Cl. ..... 174/64; 174/59; 174/65 R; 174/78; 439/585; 439/610

(58) Field of Search ..... 385/51, 87, 86; 174/78, 89, 59, 64, 65 R, 65 G; 439/607, 610, 98, 99, 465, 584, 585

(56) References Cited

U.S. PATENT DOCUMENTS

| | | | | |
|---|---|---|---|---|
| 3,982,060 | * | 9/1976 | Avery et al. | 174/75 |
| 4,096,627 | * | 6/1978 | Forney, Jr. et al. | 29/517 |
| 5,083,943 | * | 1/1992 | Tarrant | 439/585 |
| 5,137,471 | * | 8/1992 | Verespej et al. | 439/585 |
| 5,166,997 | | 11/1992 | Norland et al. | 385/87 |
| 5,559,917 | | 9/1996 | Ott | 385/86 |

FOREIGN PATENT DOCUMENTS

| | | |
|---|---|---|
| 2 057 780 | 4/1981 | (GB) . |
| 2 060 278 | 4/1981 | (GB) . |

* cited by examiner

*Primary Examiner*—Cassandra Spyrou
*Assistant Examiner*—John Juba, Jr.
(74) *Attorney, Agent, or Firm*—Jacobson Holman, PLLC

(57) ABSTRACT

An EMI-tight strain relief for a screened cable having a tubular crimp sleeve which is crimped onto the end of the cable and which includes structure for securing the strain relief in an opening in the wall of an apparatus housing. The sleeve has a crimpable portion including a circumferential groove for equalizing the necessary crimping force.

14 Claims, 1 Drawing Sheet

STRAIN RELIEF FOR A SCREEN CABLE

BACKGROUND OF THE INVENTION

1. Field of the Invention

The present invention relates to a cable strain relief of the kind having a plurality of conductors which are surrounded by common screen that is embraced by a cable casing and including a sleeve.

The invention also relates to a tool for fitting such a strain relief to a cable of corresponding diameter.

2. Description of the Related Art

A strain relief is a connection element that is coupled to the circumference of a cable and enables forces that act in the length direction of the cable, i.e. axially acting forces, to be transferred to an external construction (e.g. a cable cabinet). Such a cable will normally include a bundle of individual, insulated conductors covered with screen braiding. An insulating sleeve is provided on top of the braiding.

Such strain reliefs will preferably be electromagnetically impervious, i.e. provide electromagnetic insulation (EMI), and must also be capable of transferring forces effectively, so as to prevent individual fibers from being subjected to tensile forces in junction boxes or the like.

A known type of strain relief intended for this purpose is comprised of two tubular parts that have co-acting conical surfaces. One part (the inner part) has slits that extend axially from one end thereof, such as to form axially extending tongues. When the two parts are fitted together axially, the free ends of the tongues will be bent inwardly against the outside of the cable. The outer insulation is removed at the end of the cable and the braiding is folded back around the end of the remaining insulating sleeve. Consequently, when the two tubular parts are fitted together, parts of the braiding threads will be clamped between adjacent tongues. This often results in unsatisfactory anchoring of the strain relief to the cable.

Other known strain reliefs incorporate a U-shaped element whose legs are bent in towards the cable so as to overlap each other. This solution can result in damage to the individual conductors in the cable, and may also cause EMI-leakages to occur through the overlap.

Earlier known strain reliefs are expensive and require the use of complex devices for fitting the reliefs to cables, and also result in joints of greatly differing qualities.

SUMMARY OF THE INVENTION

Accordingly, the object of the invention is to provide a strain relief that can be fitted to cables of different standard diameters with the aid of a simple tool, such as to obtain an EMI-tight connection and a uniform result on each occasion.

Further objects of the invention will be evident from the following text, either directly or indirectly.

The invention is basically concerned with establishing a strain relief for a screened cable that includes a plurality of conductors, by crimping a crimp sleeve on that part of the cable at which the braiding has been folded back over said cable, said crimp sleeve incorporating means which function to achieve an EMI-tight coupling of the sleeve to the wall of an apparatus housing at the cable leadthrough or transit. Crimp sleeves of this kind are available in various diameters, lengths and wall thicknesses adapted to different cable diameters, so as to ensure that the crimp sleeve will be effectively anchored to the cable with the aid of a crimping tool and therewith provide an EMI-impervious cable connection.

In order to enable a generally uniform crimping force to be applied with sleeves of different diameters and different wall thicknesses, the larger crimp sleeves include a circumferential groove that reduces the crimping force required to achieve the requisite strain relief anchorage of the crimp sleeve to the cable.

The inventive crimping tool for crimping such strain relief sleeves may include a tool frame structure that has two generally parallel and mutually opposing frame members. Two opposing crimp inserts are placed between the frame members. The inserts include on their mutually facing sides recesses for crimping a sleeve of corresponding diameter on a corresponding cable. A screw meshes with a threaded hole through one frame member, so that the screw can be screwed in a direction towards the second frame member such as to bring the two inserts together. The inserts include means for guiding relative movement in said direction. The two inserts also include spring means which strive to move the inserts apart in said direction.

The two frame members have shallow recesses for receiving and localizing respective inserts. The tool can be used in conjunction with a set of insert pairs which each include crimping recesses that are adapted to crimp sleeves of correspondingly different sizes. In other respects, the insert pairs have generally equal outer dimensions in order to enable said insert pairs to be readily swapped in the frame structure. Owing to the relative guiding of the inserts and the spring means, the pair of inserts will be held automatically in the frame structure immediately the inserts are inserted thereinto, and can readily be replaced manually with another pair of inserts, by first pressing the fitted pair of inserts together against the action of the spring means and then tipping said inserts out one of the recesses and out of the frame structure. The recesses in the frame members are shallow recesses. The frame structure may conveniently have an elongated support arm and the screw may include a lever for facilitating rotation of the screw.

The invention will now be described in more detail with reference to an exemplifying embodiment thereof and also with reference to the accompanying drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications with the spirit and scope of the invention will become apparent to those skilled in the art from this detailed description.

Figure 1:
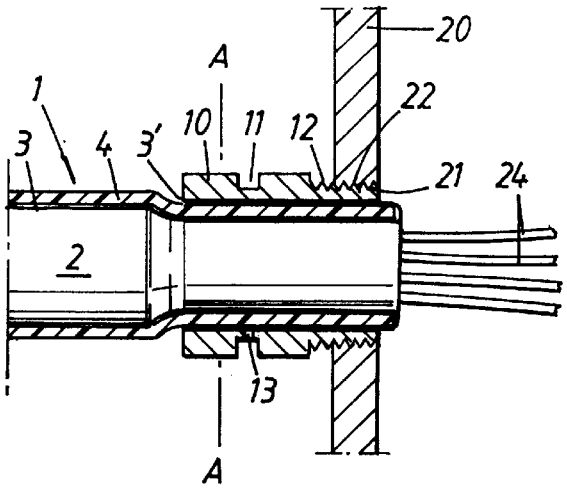
FIG. 1 shows an inventive strain relief fitted to the end of a cable and connected to the wall of an apparatus housing.
Figure 2:
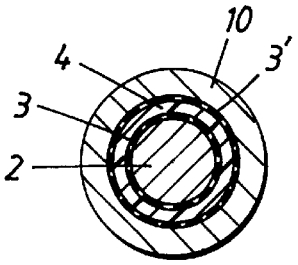
FIG. 2 is a cross-sectional view taken on the line A—A in FIG. 1 and images the strain relief prior to being crimped on the end of the cable.

FIGS. 1 and 2 illustrate a cable 1 comprising a core 2 that includes a plurality of insulated conductors 24, said core 2 being provided with screening braiding 3 which, in turn, is embraced by a cable casing 4. A length of casing 4 has been removed from the outermost end of the cable 1 and the braiding folded back over the remaining end part of the casing 4. A strain relief sleeve 10 is shown fitted over the backwardly folded screening part 3' of said end section. The front part of the sleeve 10 includes an externally threaded section 12 and also an outwardly open circumferential groove 11 between its ends. An opening 13 through the casing wall, for instance in the groove 11, enables it to be ascertained whether or not the screen 3' is located immediately beneath the sleeve 10. FIG. 1 also shows the wall 20 of an apparatus housing. The wall 20 includes an opening 21 having a thread that will mesh with the outer thread 12 on the sleeve. The sleeve 11 is anchored to the wall 20 by means of the screw joint 12, 22. The sleeve 10 lies in intimate contact with the screen 3, 3' around the whole of its circumference and tightly engages the wall 20 via the screw joint, so that the sleeve 10 will provide an EMI-tight connection to the apparatus housing (provided that the sleeve 10 and the wall 20 are made of a suitable material in this respect).

Figure 3:
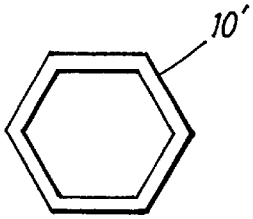
FIG. 3 illustrates the configuration of the strain relief subsequent to being crimped on the end of the cable.

The sleeve 10 is crimped onto the cable 1 so as to obtain an EMI-tight connection therewith. By crimping is meant that the sleeve 10 is subjected to plastic deformation from an essentially circular, round state into a polygonal shape, as illustrated in FIG. 3. Such crimping of the strain relief sleeve 10 provides a highly durable anchorage of the end of the cable 1 to the sleeve 10 with respect to tensile forces or strain acting in the length direction of the cable, while providing, at the same time, an EMI-tight connection between the sleeve 10 and the cable 1 and subjecting the insulated conductors 24 to stresses that are generally safe with respect to the integrity of the conductors 24.

The crimping technique requires a larger material thickness of the sleeve 10 in the case of large diameter cables 1 (with maintained crimping deformation pattern), which normally means that the crimping tool must exert crimping forces that increase markedly with increasing diameters of the cable 1 and the sleeve 10, by providing larger sleeves 10 with a circumferential groove 11 between its ends, and can limit the increase in requisite crimping forces that must be exerted by the crimping tool. This enables the use of a simple, and therewith cost favorable tool that includes exchangeable inserts that cover a whole series of differently sized sleeves 10 adapted to cables 1 of standard sizes.

Figure 4:
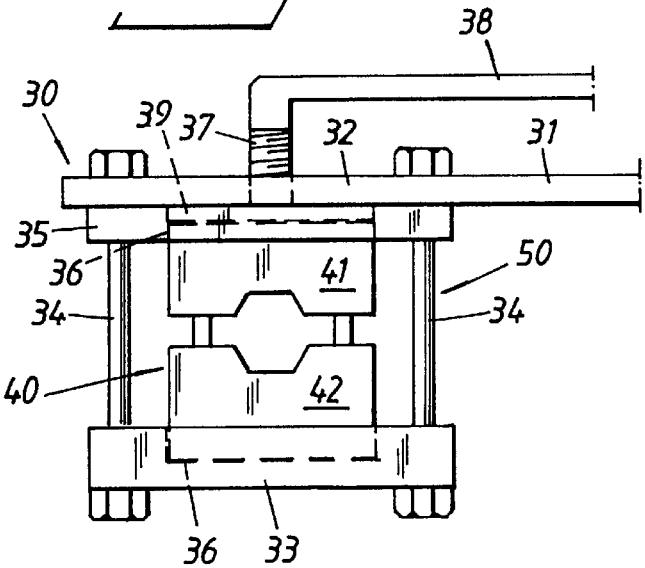
FIG. 4 shows a tool for crimping the strain relief sleeve.
Figure 5:
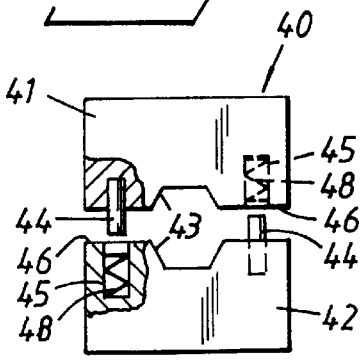
FIG. 5 is a sectional view of a crimping tool insert.

FIGS. 4 and 5 illustrate one such simple tool 30 with associated inserts 40.

The crimping insert 40 is comprised of two mutually co-acting blocks 41, 42, which may be mutually identical. Each of the blocks 41, 42 has an orthogonal parallelepipedic shape and each of the mutually opposing sides of the blocks includes a recess 43, said recesses together defining an hexagonal opening when the blocks 41, 42 are in mutual abutment. The hexagonal shape corresponds to the final external shape 10' (FIG. 3) of the crimped sleeve 10. Each block 41, 42 has a guide pin 44 on one side of the recess 43 and a corresponding aperture or hole 45 on the other side thereof. A helical spring 48 is placed on the bottom of each aperture 45. Each block 41, 42 is therewith designed so that the pin 44 of one block 41 will fit into the hole 45 in the other block, and vice versa.

Although the blocks 41, 42 are mutually identical as a result of the illustrated construction of the insert 40, it will be obvious to the person skilled in this art that the blocks 41, 42 can be constructed differently with respect to the pins 44, the holes 45 and the springs 48, while retaining the function of said blocks. FIG. 4 illustrates a tool handle 31 which has at one end a frame structure 50 formed by the end-part 32 of said handle, a so-called yoke 33 which is carried by two bolts 34 that extends perpendicularly through the yoke 33 and through the handle part 32 and take up forces that strive to move the yoke 33 away from the handle part 32. The yoke has a recessed part 36 which receives an adjacent end of the block 42. A guide plate 35 is carried on the inside of the frame structure 50, parallel with the yoke 33. The guide plate has a recess part 36 with a bottom plate 39 which is movable along the bolts 34 and which lies normal to the handle part 32.

When the blocks 41, 42 (FIG. 5) are pressed together such as to bring their adjacent surfaces 46 essentially into contact with one another, the insert 40 can be inserted laterally into the frame structure 50 in alignment with the recess 36, whereafter the insert 40 is allowed to expand under the action of the spring 48 to the state shown in FIG. 4, where the insert 40 is thus held by the expansion forces of the springs 48. The insert 40 can, nevertheless, be easily removed from the frame structure, by first compressing the insert and then tilting it out of the frame structure 50.

Shown in FIG. 4 is a screw 37 which is threaded through a through-penetrating opening in the handle part 32 and acts against the bottom plate 39 in the recess 36 in the plate 35, such as to push the plate 35 towards the yoke 33. The screw 37 is provided with a long, lateral lever 38 by means of which heavy torque can be exerted manually on the screw 37, while rotational forces can be counteracted at the same time, by holding against the handle end 31. The screw 37 and its co-acting thread in the handle 31 form a transmission mechanism for linear movement of the insert blocks 41, 42 towards one another when crimping a sleeve 10 on the end-section of a cable 1.

A series of inserts 40 that have essentially identical external dimensions but recesses 43 of mutually different sizes can be used in conjunction with the tool 30. These inserts 40 can be readily exchanged in the tool 30, which has an extremely simple construction as evident from the aforegoing.

When the crimp sleeve has been crimped firmly to the cable with a radial load that is distributed generally uniformly in the length direction of the sleeve, the sleeve will be deformed radially more pronouncedly at its ends (i.e. obtain a smaller diameter) than in its central region. This effect is apparently due to weakening of the sleeve wall by the center groove 11. This results in the section of cable located in the sleeve between its ends being stretched axially to some extent, which could be detrimental to the conductors in the cable. Instead, the cable section is compressed in the crimp sleeve, wherewith inclination of the end-edges of the sleeve provides a particularly effective transfer of axial forces between the crimped sleeve and the cable.

It will be noted in particular that the crimped sleeve and the crimping force engage all conductors, conductor insulation, screens and the like in the cable, so that all cable parts will obtain an axial force-coupling to one another and to the crimped sleeve, such that said cable components will not experience any relative axial movement when axial forces are applied. Furthermore, the crimping affords radial compression of the cable, so that the cable will be sealed against axial fluid throughflows between the cable components. It will also be noted that the crimp sleeve is a single ring-shaped element, which facilitates work in fitting the sleeve.

Although the crimp sleeve is shown in FIG. 1 to be provided with an axial tubular extension having an outer thread, it will be understood that this extension can be omitted and a separate sleeve nut or the like that axially couples the sleeve to an externally thread leadthrough sleeve on an apparatus housing or the like instead.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A strain relief for a screen cable comprising a plurality of conductors which are surrounded by a common screen, and a cable casing embracing said screen, said strain relief including a tubular crimp sleeve that is crimped on the cable on the screen folded back over the cable casing, said crimp sleeve having a crimpable portion with a generally rectangular cross section and an external circumferential groove approximately centered in said crimpable portion, an area of said groove being less than a remaining ungrooved area of said crimpable portion, said groove for reducing a force required to crimp said sleeve, said crimp sleeve coupling the strain relief to an apparatus housing wall via a cable leadthrough or transit.

2. The strain relief according to claim 1, wherein the crimp sleeve and the apparatus housing wall are adapted to provide an EMI-tight connection of the cable to an interior of the housing wall.

3. The strain relief according to claim 1, wherein a wall of the crimp sleeve includes an inspection opening.

4. The strain relief as set forth in claim 1, wherein an area of said circumferential groove is less than half the remaining area of said crimpable portion.

5. The strain relief as set forth in claim 1, wherein said generally rectangular cross section of said crimp sleeve is of substantially a same thickness on either side of said circumferential groove.

6. A strain relief for a screen cable comprising a plurality of conductors which are surrounded by a common screen, a cable casing embracing said screen, and a tubular crimp sleeve that is crimped on a cable on the screen folded back over the cable casing, said crimp sleeve including an inspection opening and means for coupling the crimp sleeve to an apparatus housing wall via a cable leadthrough or transit.

7. The strain relief as set forth in claim 6, wherein said crimp sleeve has a generally rectangular cross section with a circumferential groove for reducing a force required to crimp said sleeve.

8. The strain relief as set forth in claim 7, wherein said circumferential groove is approximately centered in a crimpable portion of said crimp sleeve.

9. The strain, relief as set forth in claim 7, wherein portions of said generally rectangular cross section of said crimp sleeve on either side of said circumferential groove have a substantially same thickness.

10. A strain relief for a screen cable comprising a conductor surrounded by a common screen with a cable casing embracing said screen, and a tubular crimp sleeve that is crimped on the cable on the screen folded back over the cable casing, said crimp sleeve having a crimpable portion with a generally rectangular cross section and an external circumferential groove for reducing a force required to crimp said sleeve, an area of said groove being less than a remaining area of said crimpable portion, a crimping force of said tubular crimp sleeve providing radial compression and engaging all conductors, conductor insulation and screens in said cable so that all cable parts obtain an axial force-coupling to one another and to the crimped sleeve.

11. The strain relief as set forth in claim 10, wherein said generally rectangular cross section of said crimp sleeve is of substantially a same thickness on either side of said circumferential groove.

12. The strain relief as set forth in claim 10, wherein said circumferential groove is approximately centered in said crimpable portion.

13. The strain relief as set forth in claim 10, said crimp sleeve further including structure for coupling the crimp sleeve to an apparatus housing wall via a cable leadthrough or transit.

14. The strain relief as set forth in claim 10, wherein a wall of said crimp sleeve includes an inspection opening.

* * * * *